US006866473B2

(12) United States Patent
Otsuka

(10) Patent No.: US 6,866,473 B2
(45) Date of Patent: Mar. 15, 2005

(54) BLOWER

(75) Inventor: Shuichi Otsuka, Kitasaku-gun (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 10/410,258

(22) Filed: Apr. 10, 2003

(65) Prior Publication Data

US 2003/0190232 A1 Oct. 9, 2003

Related U.S. Application Data

(63) Continuation of application No. 09/898,166, filed on Jul. 5, 2001, now abandoned.

(30) Foreign Application Priority Data

Jul. 19, 2000 (JP) ..... 2000-219490

(51) Int. Cl.[7] ..... F04D 29/66
(52) U.S. Cl. ..... 415/119; 415/206; 415/212.1
(58) Field of Search ..... 415/119, 206, 415/212.1

(56) References Cited

U.S. PATENT DOCUMENTS 2,151,631 A 4/1939 Anderson
3,093,299 A 6/1963 Hammann et al.
5,536,140 A 7/1996 Wagner et al.
6,039,532 A * 3/2000 McConnell ..... 415/119
6,200,093 B1 3/2001 Lee et al.
6,254,336 B1 7/2001 Ahn

FOREIGN PATENT DOCUMENTS

JP 40110039 A 4/1989

* cited by examiner

*Primary Examiner*—Ninh H. Nguyen
(74) *Attorney, Agent, or Firm*—Oliff & Berridge, PLC

(57) ABSTRACT

This invention is designed to reduce a harsh noise, by suppressing a wind noise generated at a wind-receiving end, which is caused by forming the wind-receiving end of an outlet port for air so as to be parallel to a side extending along the direction of the rotation axis of a vane of an impeller. The wind-receiving end of the outlet port is provided in the form of steps or with inclination with respect to a side extending along the direction of the rotation axis of a vane of the impeller so that the wind sent and blown out by the vanes of the impeller is prevented from blowing against the wind-receiving end all at once throughout its entire width.

3 Claims, 5 Drawing Sheets

RELATED ART

RELATED ART

BLOWER

This is a Continuation of applicaton Ser. No. 09/898,166 filed Jul. 5, 2001 now abandoned. The entire disclosure of the prior application is hereby incorporated by reference herein in its entirety.

BACKGROUND OF THE INVENTION

1. Field of the Invention

The present invention relates to a blower designed to suppress noise.

2. Description of the Related Art

A conventional blower is described below with reference to FIGS. 6 and 7. In each of the figures, reference numeral 1 designates a casing comprising a main body 1*a* and a cover 1*b*, which is formed to have inlet ports 1*c* and an outlet port 1*d* for air. A motor 2 and an impeller 3 are housed within the casing 1. The impeller 3 is rotated by the motor 2 in the direction of an arrow A in FIG. 6. By the rotation of the impeller 3, air is sucked from the inlet ports 1*c* of the casing 1 as shown by an arrow B in FIG. 7, and is discharged from the outlet port 1*d* as shown by an arrow C in FIG. 6 to send air.

Since air is sent in accordance with the rotation of the impeller 3, the wind thereby created forms a current (air flow) which flows slightly in the rotating direction of the impeller 3. Referring to the conventional blower described above, a wind-receiving end 1*d*1 of the outlet port 1*d* located on the inward side of an air flow (the lower side in the drawing) is formed in parallel with sides (long sides) 3*a*1 extending along the direction (horizontal direction) of the rotation axis of a vane 3*a* (as illustrated in FIG. 7).

Therefore, the wind sent and blown out by the vanes 3*a* of the impeller 3 blows against the wind-receiving end 1*d*1 of the outlet port 1*d* all at once throughout its entire width, which causes a loud wind noise. More specifically, the result of the measurement shown in FIG. 8 (the result gained at a distance of 1 m away from the outlet port 1*d*) reveals that a noticeable peak tone 81 is generated in the vicinity of the frequency of 3 kHz. As this peak tone is often sensed as a harsh noise, it was a demand to overcome this problem.

SUMMARY OF THE INVENTION

The present invention has been made in view of the demand mentioned above. An object of the present invention is therefore to provide a blower capable of suppressing a wind noise generated at the wind-receiving end of an outlet port and reducing a harsh noise.

In order to achieve the object, according to a first aspect of the present invention, there is provided a blower, in which a motor and an impeller are housed within a casing having inlet ports and an outlet port, the impeller being rotated by the motor so that air is sucked from the inlet ports of the casing and discharged from the outlet port to send air; characterized in that a wind-receiving end of the outlet port located on an inward side of an air flow is formed so as to be inclined with respect to a side extending along the direction of the rotation axis of each vane of the impeller.

According to a second aspect of the present invention, the blower of the first aspect of the invention is characterized in that the maximum value of the inclination of the wind-receiving end of the outlet port is the value obtained by dividing a vane pitch of the impeller by the length of the side extending along the direction of the rotation axis of each vane of the impeller.

According to a third aspect of the present invention, there is provided a blower, in which a motor and an impeller are housed within a casing having inlet ports and an outlet port, the impeller being rotated by the motor so that air is sucked from the inlet ports of the casing and discharged from the outlet port to send air; characterized in that a wind-receiving end of the outlet port located on an inward side of an air flow is provided in the form of steps, including upper and lower steps each parallel to a side extending along the direction of the rotation axis of a vane of the impeller, and having a level difference in its middle.

According to a fourth aspect of the present invention, the blower of the third aspect of the invention is characterized in that the dimension of a vane pitch of the impeller is set as the maximum amount of the level difference in the wind-receiving end of the outlet port.

In the blower according to the first and third aspects of the present invention, the wind-receiving end of the outlet port is formed to have a level difference or inclination with respect to the side extending along the direction of the rotation axis of each vane of the impeller.

With this structure, the wind sent and blown out by vanes of the impeller does not blow against the wind-receiving end all at once throughout its entire width, and hereby the blower acts to suppress a wind noise.

The blower according to the second and fourth aspects of the present invention is designed to suppress a wind noise with the required minimum amount of the inclination or of the level difference by setting the pitch of one vane as the maximum value of the inclination or of the level difference (the dimension of a cut-out part, formed in the wind-receiving end part, in the rotating direction of the vanes) in the first and third aspects of the present invention.

BRIEF DESCRIPTION OF THE DRAWINGS

Other features and characteristics are apparent from the description which follows with reference to the attached drawings in which.

DETAILED DESCRIPTION OF THE PREFERRED EMBODIMENTS

Embodiments of the present invention are described hereafter using the attached drawings.

Figure 1:
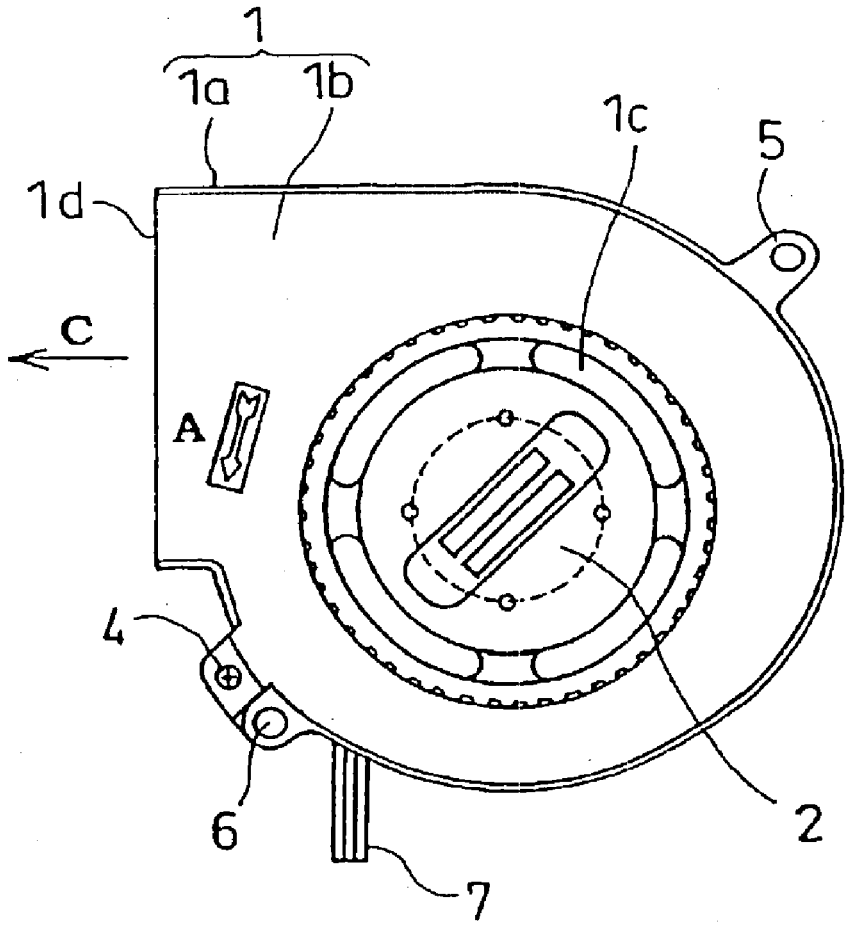
FIG. 1 is a plan view showing one embodiment of a blower according to the present invention.
Figure 2:
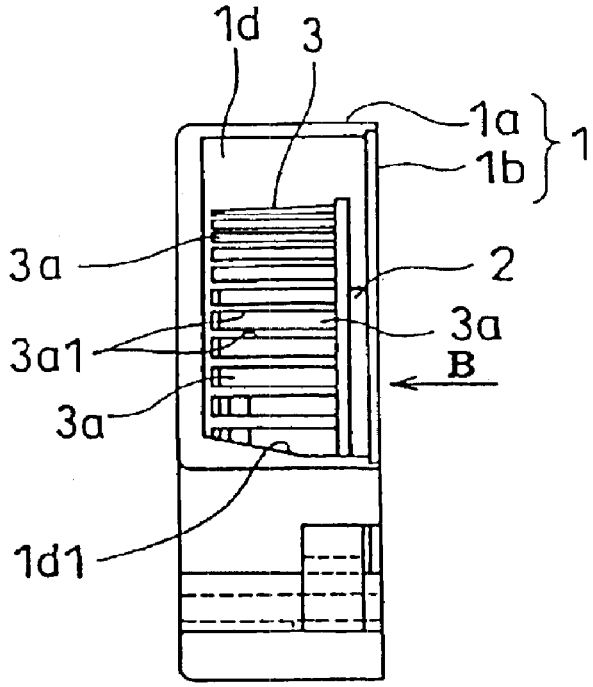
FIG. 2 is a left side view of the above blower.

FIG. 1 is a plan view showing one embodiment of a blower according to the present invention, and FIG. 2 is a left side view of said blower.

In each figure, reference numeral 1 designates a scroll-type casing comprising a main body 1*a* and a cover 1*b*. The casing 1 is formed to have inlet ports 1*c* and an outlet port 1*d* for air. The inlet ports 1*c* are formed on the central part of the cover 1*b* of the casing 1, and the outlet port 1*d* is formed on a side surface of the main body 1*a* substantially perpendicular to a surface of the cover 1*b*.

A motor 2 and an impeller 3 are housed within the casing 1. The impeller 3 is positioned substantially at the center of the inside of the casing 1 so that approximately one fourth of its rotating surface is just opposed to the outlet port 1*d*. The motor 2, here, is an outer-rotor-type, and the impeller 3 is attached to the outer periphery of a rotor; however, the motor 2 is not limited to the outer-rotor-type.

A screw 4 is for attaching the cover 1*b* of the casing 1 to the main body 1*a*. A lead wire 7 is for supplying power to the motor 2. Reference numerals 5 and 6 designate holes for use in the installation of the blower.

In the present invention, as apparent from FIG. 2, a wind-receiving end 1*d*1 of the outlet port 1*d* located on the inward side of an air flow (the lower side in FIG. 2) is formed so as to be inclined with respect to sides (long sides) 3*a*1 extending along the direction (horizontal direction) of the rotation axis of a vane 3*a*.

Figure 3:
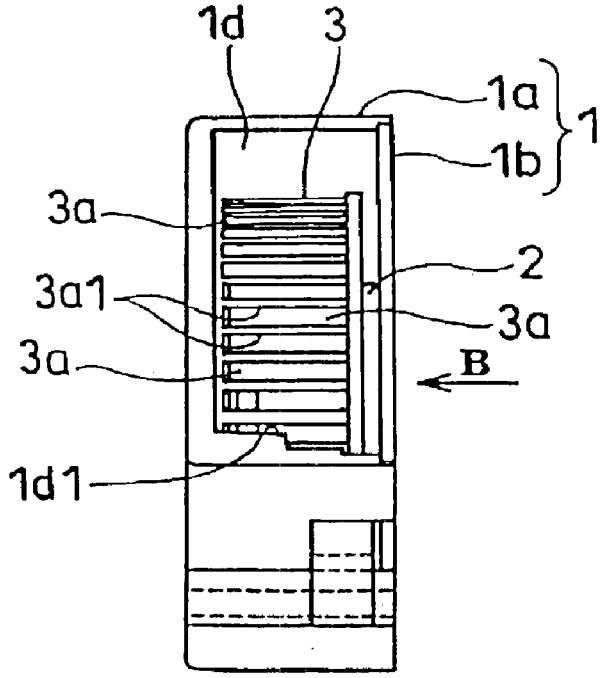
FIG. 3 is a left side view showing another embodiment of a blower according to the present invention.

As shown in FIG. 3, the wind-receiving end 1*d*1 may be provided in the form of steps, including the upper and lower steps each parallel to the long sides 3*a*1, and having a level difference in its middle. Referring to FIG. 3, the same reference numerals as those in FIG. 2 indicate the portions same as or corresponding to those in FIG. 2.

The operation of the blower according to the present invention is described below.

When the motor 2 rotates by being supplied with power through the lead wire 7, the impeller 3 rotates in the direction of an arrow A in FIG. 1. Hereby, air is sucked from the inlet ports 1*c* of the casing 1 as shown by an arrow B in FIG. 2, and is thereafter discharged via the impeller 3 (the vanes 3*a*) from the outlet port 1*d* as shown by an arrow C in FIG. 1 to send air.

In the above case, the wind-receiving end 1*d*1 of the outlet port 1*d* located on the inward side of an air flow is formed with inclination or a level difference as described above, so that the wind sent and blown out by the impeller 3 (the vanes 3*a*) does not blow against the wind-receiving end 1*d*1 all at once throughout its entire width; which deadens a wind noise almost completely.

It is inferred that the above phenomenon occurs because a part of the wind sent and blown out by the impeller 3 (the vanes 3*a*) passes by a cut-out part, which is formed inevitably in the wind-receiving end due to the inclination or the steps thereof.

Figure 4:
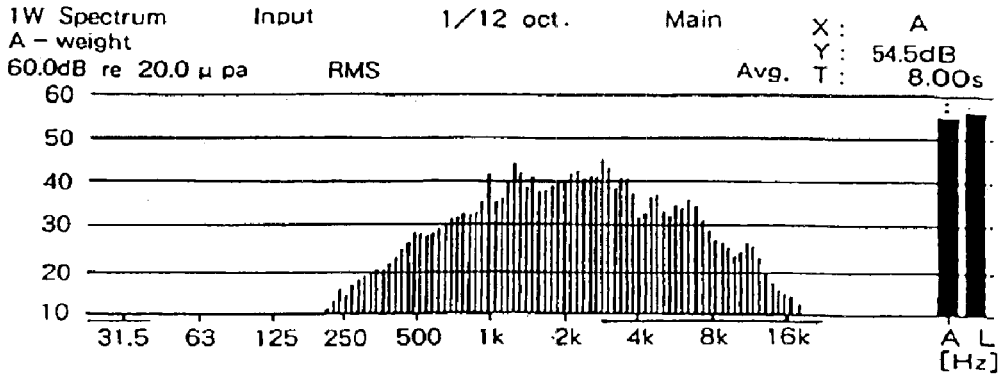
FIG. 4 is a graph showing the noise characteristic of the blower shown by the embodiment in FIG. 2.
Figure 8:
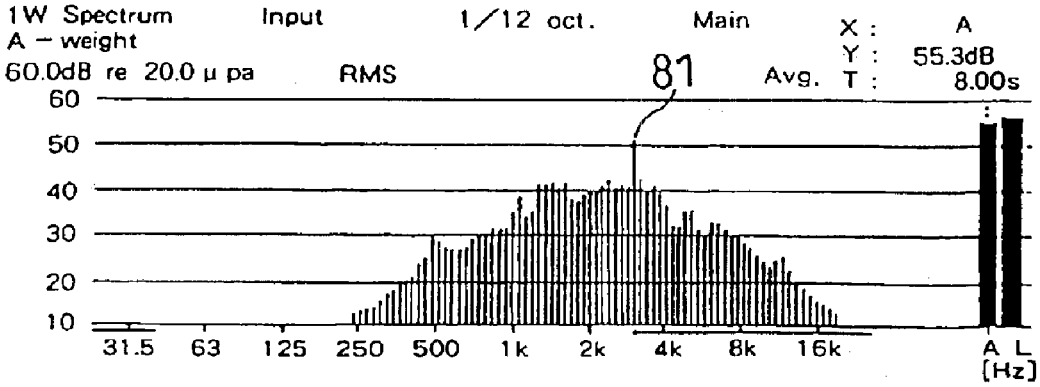
FIG. 8 is a graph showing the noise characteristic of the conventional blower shown in FIG. 7.

FIG. 4 shows the condition where a wind noise is substantially suppressed because of the inclination (the result of the measurement obtained at a distance of 1 m away from the outlet port 1*d*, which is similar to the result shown in FIG. 8). In other words, a peak tone 81 generated in the vicinity of the frequency of 3 kHz shown in FIG. 8 disappears in FIG. 4. In addition, while a total noise is 55.3 dB in the example shown in FIG. 8, it is 54.5 dB in the example shown in FIG. 4, which is smaller by about 1 dB than the total noise of the example shown in FIG. 8.

Figure 5:
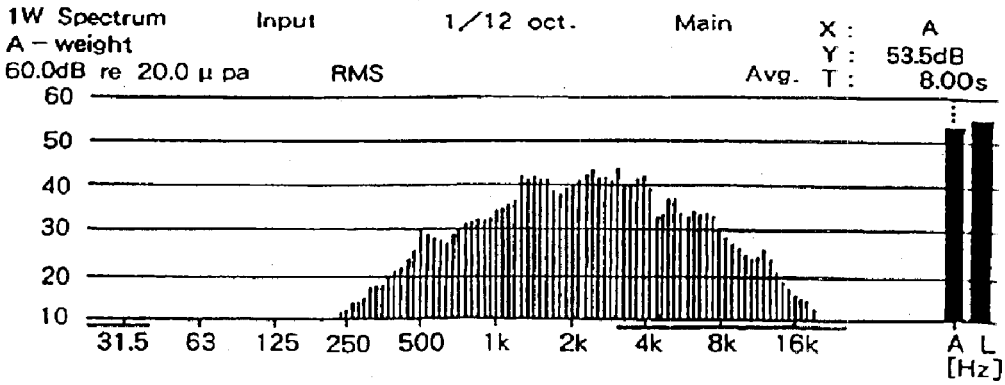
FIG. 5 is a graph showing the noise characteristic of the blower shown by the embodiment in FIG. 3.
Figure 6:
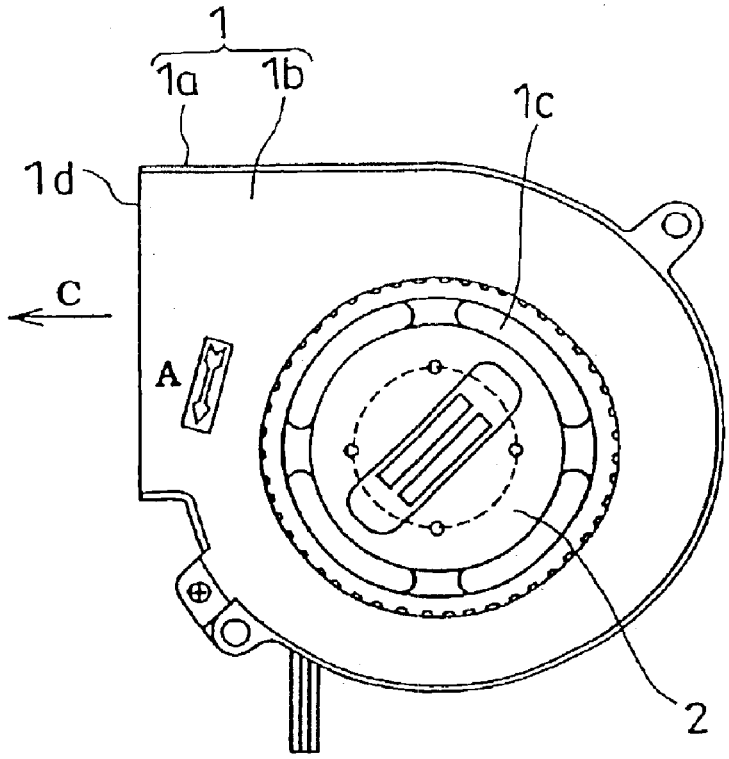
FIG. 6 is a plan view of a conventional blower.
Figure 7:
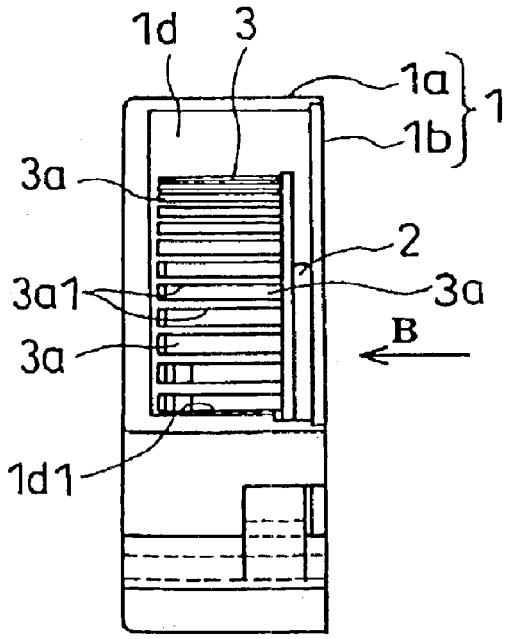
RELATED ART FIG. 7
FIG. 7 is a left side view of the above conventional blower.

FIG. 5 shows the condition where the wind noise is substantially suppressed because of the level difference (the result of the measurement obtained at a distance of 1 m away from the outlet port 1*d*, which is similar to the results shown in FIGS. 8 and 4). That is to say, the peak tone 81 generated in the vicinity of the frequency of 3 kHz shown in FIG. 8 disappears in FIG. 5 as in FIG. 4. In the example shown in FIG. 5, a total noise is 53.5 dB which is smaller by about 2 dB than that of the example shown in FIG. 8.

Referring to FIG. 2, it is preferable to set a value s1 (the vane pitch of the impeller 3)/(the length of the side 3*a*1 extending along in the direction of the rotation axis of the vane 3*a* of the impeller 3) as the maximum value of the inclination of the wind-receiving end 1*d*1.

Referring to FIG. 3, it is preferable to set a vane pitch dimension p1 of the impeller 3 as the maximum amount of the level difference of the wind-receiving end 1*d*1.

The wind sent and blown out by the vanes 3*a* of the impeller 3 is microscopically a succession of winds (waves) blown by each vane. Accordingly, the passing of the wind due to the inclination and the level difference (the cut-out part of the wind-receiving end 1*d*1) can basically be considered to occur in one vane as a unit. Therefore, the pitch of one vane is supposed to be sufficient as the maximum value of the dimension of the cut-out part, formed by the inclination or level difference, in the rotating direction of the vane 3*a*; whereas, if the maximum value is fixed higher than that, there will be generated a deviation in the distribution of the air amount or a vortex at the wind-receiving end 1*d*1; which will generate a noise rather than reduce it, and may cause a new problem.

As for the orientation of the inclination or the steps, either the right side or the left side of the wind-receiving end 1*d*1 shown in FIGS. 2 and 3 may be arbitrarily formed as an ascending side (or descending side). Reversely to the illustrated examples, the right side of the wind-receiving end 1*d*1 may be formed as the ascending side.

As mentioned above, according to the present invention, since the wind-receiving end of the outlet port is formed so as to have a level difference or inclination with respect to the side extending along the direction of the rotation axis of the vanes of the impeller, the wind sent and blown out by the vanes of the impeller does not blow against the wind-receiving end all at once throughout its entire width. Accordingly, it is possible to suppress the wind noise effectively, and thus to reduce a harsh noise.

Furthermore, according to the present invention, since the pitch of one vane is set as the maximum value of the inclination or the level difference (the dimension of the cut-out part, formed in the wind-receiving end part, in the rotating direction of the vane), it is possible to suppress the wind noise with the required minimum amount of the inclination or of the level difference.

What is claimed is:

1. A blower having a motor and an impeller which are housed within a casing provided with inlet ports and an outlet port, said impeller being rotated by said motor so that air is sucked from the inlet ports of said casing and discharged from said outlet port of said casing to send air, wherein a wind-receiving end of said outlet port located on the inward side of an air flow is formed with inclination with respect to a side extending along the direction of the rotation axis of each vane of said impeller and the maximum value of the inclination of said wind-receiving end of said outlet port is the value obtained by dividing a vane pitch of said impeller by the length of the side extending along the direction of the rotation axis of each vane of said impeller.

2. A blower having a motor and an impeller which are housed within a casing provided with inlet ports and an outlet port, said impeller being rotated by said motor so that air is sucked from said inlet ports of said casing and discharged from said outlet port of said casing to send air, wherein a wind-receiving end of said outlet port located on the inward side of an air flow is provided in the form of steps, including upper and lower steps each parallel to the side extending along the direction of the rotation axis of said vane of said impeller, and having a level difference in its middle.

3. The blower according to claim 2, wherein the dimension of a vane pitch of said impeller is set as the maximum amount of the level difference in said wind-receiving end of said outlet port.

* * * * *